US009142377B2

(12) United States Patent
Wittwer et al.

(10) Patent No.: US 9,142,377 B2
(45) Date of Patent: Sep. 22, 2015

(54) CATHODE HOUSING SUSPENSION OF AN ELECTRON BEAM DEVICE

(75) Inventors: Hans Wittwer, Mamishaus (SE); Urs Hostettler, Thun (SE); Hans Reusser, Mamishaus (SE); Toni Waber, Aefligen (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/125,989

(22) PCT Filed: Jun. 27, 2012

(86) PCT No.: PCT/EP2012/062450

§ 371 (c)(1),
(2), (4) Date: Dec. 13, 2013

(87) PCT Pub. No.: WO2013/004562

PCT Pub. Date: Jan. 10, 2013

(65) Prior Publication Data

US 2014/0091702 A1 Apr. 3, 2014

Related U.S. Application Data

(60) Provisional application No. 61/525,114, filed on Aug. 18, 2011.

(30) Foreign Application Priority Data

Jul. 4, 2011 (SE) ..... 1100516

(51) Int. Cl.
*H01J 1/88* (2006.01)
*H01J 33/02* (2006.01)

(Continued)

(52) U.S. Cl.
CPC ... *H01J 1/88* (2013.01); *G21K 5/02* (2013.01); *H01J 9/36* (2013.01); *H01J 33/02* (2013.01)

(58) Field of Classification Search
CPC ..... H01J 1/88; H01J 9/36; H01J 33/02; G21K 5/02
See application file for complete search history.

(56) References Cited

U.S. PATENT DOCUMENTS 3,321,577 A * 5/1967 Burke et al. ..... 348/825
3,727,093 A * 4/1973 Fink ..... 313/237

(Continued)

FOREIGN PATENT DOCUMENTS

DE 1 093 055 B 11/1960
JP 9-230100 A 9/1997

OTHER PUBLICATIONS

International Search Report (PCT/ISA/210) mailed on Oct. 8, 2012, by the European Patent Office as the International Searching Authority for International Application No. PCT/EP2012/062450.

*Primary Examiner* — Thomas A Hollweg
(74) *Attorney, Agent, or Firm* — Buchanan Ingersoll & Rooney PC

(57) ABSTRACT

A cathode-housing suspension of an electron beam device having a tubular body of elongate shape with an exit window extending in the longitudinal direction and a connector end in one end of the tubular body is disclosed. The electron beam device further comprises a cathode housing having an elongate shape and comprising a free end and an attachment end remote to the free end, and the attachment end comprises an outwardly extending flange provided with threaded openings for set screws and non-threaded openings for attachment bolts, for attaching the attachment end to a corresponding socket of the tubular body, wherein a mechanism configured to bias the attachment end away from the socket are arranged in the tubular body.

17 Claims, 2 Drawing Sheets

(51) Int. Cl.
*H01J 9/36* (2006.01)
*G21K 5/02* (2006.01)

(56) References Cited

U.S. PATENT DOCUMENTS 3,749,967 A * 7/1973 Douglas-Hamilton et al. 315/85
3,780,334 A * 12/1973 Leboutet ..... 313/299
4,061,944 A * 12/1977 Gay ..... 313/420
4,461,972 A * 7/1984 Dmitriev et al. ..... 313/420
5,451,794 A * 9/1995 McKeown et al. ..... 250/492.3
5,504,799 A * 4/1996 Suzuki ..... 378/136
5,621,270 A * 4/1997 Allen ..... 313/420
5,729,583 A * 3/1998 Tang et al. ..... 378/122
5,877,588 A 3/1999 Kaftanov et al.
7,148,613 B2 * 12/2006 Dally et al. ..... 313/361.1
2005/0225224 A1 * 10/2005 Dally et al. ..... 313/361.1
2007/0278928 A1 12/2007 Lee et al.
2011/0062353 A1 * 3/2011 Cooper ..... 250/503.1
2011/0198513 A1 * 8/2011 Holm ..... 250/492.3
2012/0175532 A1 * 7/2012 Victor et al. ..... 250/492.3
2014/0103228 A1 4/2014 Waber
2014/0117259 A1 5/2014 Holm et al.
2014/0117838 A1 5/2014 Reusser
2014/0145589 A1 5/2014 Haag et al.

* cited by examiner

CATHODE HOUSING SUSPENSION OF AN ELECTRON BEAM DEVICE

TECHNICAL BACKGROUND

The present invention relates to an electron beam device (EBD), and in particular to an EBD with improved properties in relation to a cathode housing thereof.

A typical EBD comprises a vacuum tight body inside which a cathode housing is arranged. The cathode housing comprises a filament which is heated by a current in order for electrons to be produced. The thus produced electrons are accelerated by means of a high-voltage potential and exits through an exit window of the body, typically a thin window foil supported by a support grid. Electron beam devices may be used for several purposes, such as curing of paint or adhesives, or sterilisation of volumes or surfaces. Depending on the application properties such as acceleration voltage, beam profile, shape of the EBD will vary. The teachings of the present invention may advantageously be applied to EBD:s used for sterilization of a web of packaging material, since it may significantly improve the performance of EBD:s being designed for that purpose. It is to be understood, however that it may be applied to other EBD:s having a similar construction for which similar advantages may be obtained.

Within the field of sterilization of a web of packaging material, performance factors such as stability, durability and longevity are key issues, once the quality of the sterilization is ensured. All components mentioned and still more may be optimized in order for the EBD to produce the desired beam shape under any given circumstances.

The present invention relates to the context of elongate electron beam devices used for treatment of larger surface, such as webs of packaging material used for production of packaging containers. More specifically the present invention relates to improvements of such EBD:s, in terms of ensuring adequate quality while simplifying assembly of the EBD.

SUMMARY

According to the present invention there is provided a cathode-housing suspension of an electron beam device having a tubular body of elongate shape with an exit window extending in the longitudinal direction and a connector end in one end of the tubular body. The electron beam device further comprises a cathode housing having an elongate shape and comprising a free end and an attachment end remote to the free end, and the attachment end comprises an outwardly extending flange provided with threaded openings for set screws and non-threaded openings for attachment bolts, for attaching the attachment end to a corresponding socket of the tubular body, wherein means configured to bias the attachment end away from the socket are arranged in the tubular body.

One advantage of a suspension in accordance with the present embodiment is that it facilitates aligned mounting of cathode housing. In particular it enables perfect positioning of the cathode housing in relation to the tube body without the need of machining constructional details with overly small tolerances. This in turn enables a simplified production of components, and a faster assembly of the device. The resulting suspension will be flexible in regard of its assembly, yet rigid in its assembled state. Even small deviations in the position of the cathode housing may have considerable impact on the performance of the electron-beam device. It may for instance affect the beam profile, and alterations in the beam profile may in turn affect the longevity of the device.

In one or more embodiments the connector end may comprise concentrically arranged cylindrical connector elements separated by annular ceramic spacers, wherein the ceramic spacers are arranged in a staggered fashion, such that adjacent spacers are shifted in the longitudinal direction in relation to each other, which results in a number of advantages listed in the detailed description. In further embodiments where every other ceramic spacer is aligned in the longitudinal direction the stability of the suspension is even further increased.

In one or more embodiments the biasing means comprises a plate spring arranged between the attachment end and the socket. The plate spring will provide a reliable biasing means, which may easily be localized in the adequate position, e.g. by having openings through which the screws and bolts may extend.

In a number of embodiments the number of attachment bolts may be three, which provides a simplistic yet fully flexible solution, and in order to maximize symmetry the attachment bolts may be distributed evenly on the flange. The set screws may, irrespective of the number of attachment bolts, be located between adjacent attachment bolts. In some embodiments the set screws may be arranged equidistant from adjacent attachment bolts (in between two attachment bolts), and in other embodiments the set screws may be arranged closer to one attachment bolt. A reason for the latter may be that a lateral distance between opposing forces should be minimized (in the first example they are maximized), which may be desired depending on the dimensions of the flange, etc.

In one or more embodiments the connector end is delimited by a cylinder segment welded to the tubular body, wherein the socket is concentrically suspended in a ceramic isolator disc brazed to the inner perimeter of the cylinder segment. This construction enables for all tuning of the cathode-housing suspension to be performed outside of the constraints of the EBD, which would still be possible if desired.

In order to decrease the risk of generation of excessive electric field strength and the generation of sparks the socket may have a curved surface on a side remote to the cathode housing.

The present invention also relates to a method for suspending a cathode housing in a connector end of an electron beam device comprising the steps of

- arranging biasing means between an attachment end of the cathode housing and a corresponding socket of the connector end of the electron beam device
- compressing the biasing means partially by means of attachment bolts extending from the cathode housing and being engaged in threaded openings of the socket, or vice versa,
- adjusting the attachment bolts until the cathode housing has the desired inclination,
- fixating the position of the cathode housing by means of tightening set screws.

The method may also comprise the step of welding the connector end to one end of a tubular body of an EBD. In one or more embodiments the method may also comprise the step of evacuating the tubular body and sealing it, for generation of a sealed electron beam device, where a vacuum pump is not required to maintain the adequate degree of vacuum in the EBD.

DETAILED DESCRIPTION

DETAILED DESCRIPTION

Figure 1:
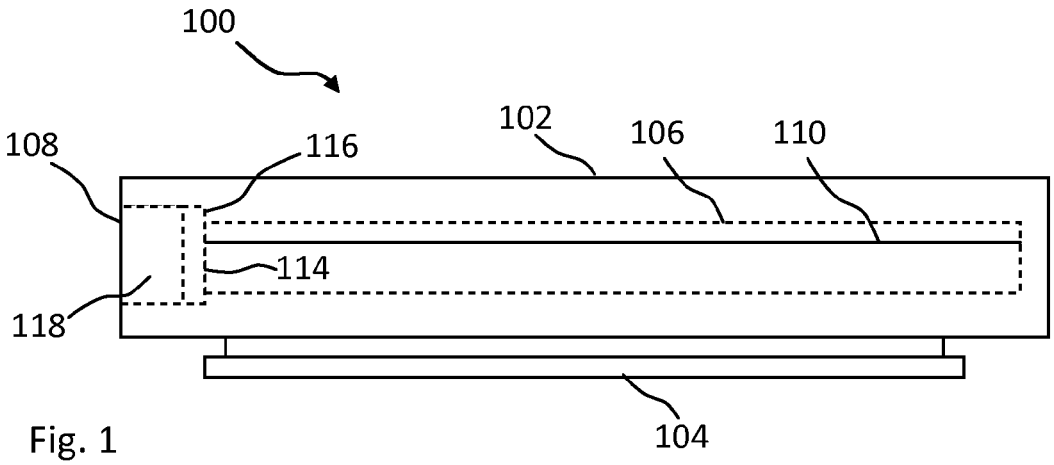
FIG. 1 is a schematic side view of an electron beam device which may comprise a suspension in accordance with one embodiment of the present invention.

FIG. 1 illustrates a side view of an electron beam device according to a first embodiment of the present invention. The purpose of the drawing is simply to illustrate the basic components of an electron beam device, and it should be emphasized that the purpose is not to provide a true constructional drawing or in any other way limit the present invention.

The electron beam device 100 of FIG. 1 comprises a tube body 102 having an exit window arrangement 104. The exit window arrangement 104 in turn comprises subassemblies not relevant for the present invention, yet having the properties of providing an outlet window for electrons while preserving vacuum inside the tube body 102. Components inside the vacuum tube 102 are illustrated by the phantom lines. A cathode housing 106 extends from a connection end 108 of the tube body 102. In this context it should be mentioned that the connection end 108 may be removable or rigidly attached to the rest of the tube body 102. In the present embodiment an outer cylinder segment of the connection end 108 is welded to the tube body 102, which is showed in more detail referring to FIGS. 3-5.

Within the constraints of the cathode housing 106 a filament 110 is arranged. A control grid 112 (not shown in FIG. 1) may also be arranged as part of the cathode housing 106, which control grid 112 is used for better control of the electron emission. The application of a separate and variable electrical potential to the control grid 112 makes it possible to use it for active shaping of the generated electron beam. In its simplest use a negative potential may be used in order to block the electrons from leaving the cathode housing. For these purposes the control grid 112 may be electrically connected to a separate power supply (not shown).

In use, an electron beam is generated by heating the filament, using a current, and by accelerating the electron towards the exit window 104 by means of a high-voltage potential.

Figure 2:
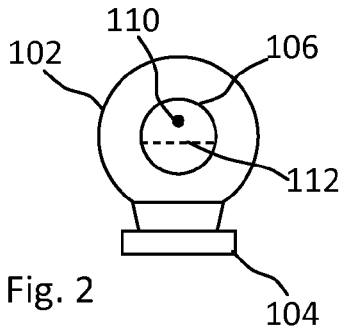
FIG. 2 is a schematic cross section of the electron beam device of FIG. 1.

An attachment end 114 of the cathode housing 106 comprises an outwardly extending flange 116. The flange 116 connects to a socket 118 of the connection end 108 by means of screws, and this suspension will be explained in more detail referring to FIG. 3. First, FIG. 2 is an end view further illustrating the shape of the EBD of FIG. 1. Again, the purpose is simply to illustrate the present invention, not to limit the invention in any unreasonable way, the skilled person will realize, upon reading the present application, that there are several applications for the present invention as defined by the claims. The socket may be made of stainless steel.

Figure 3:
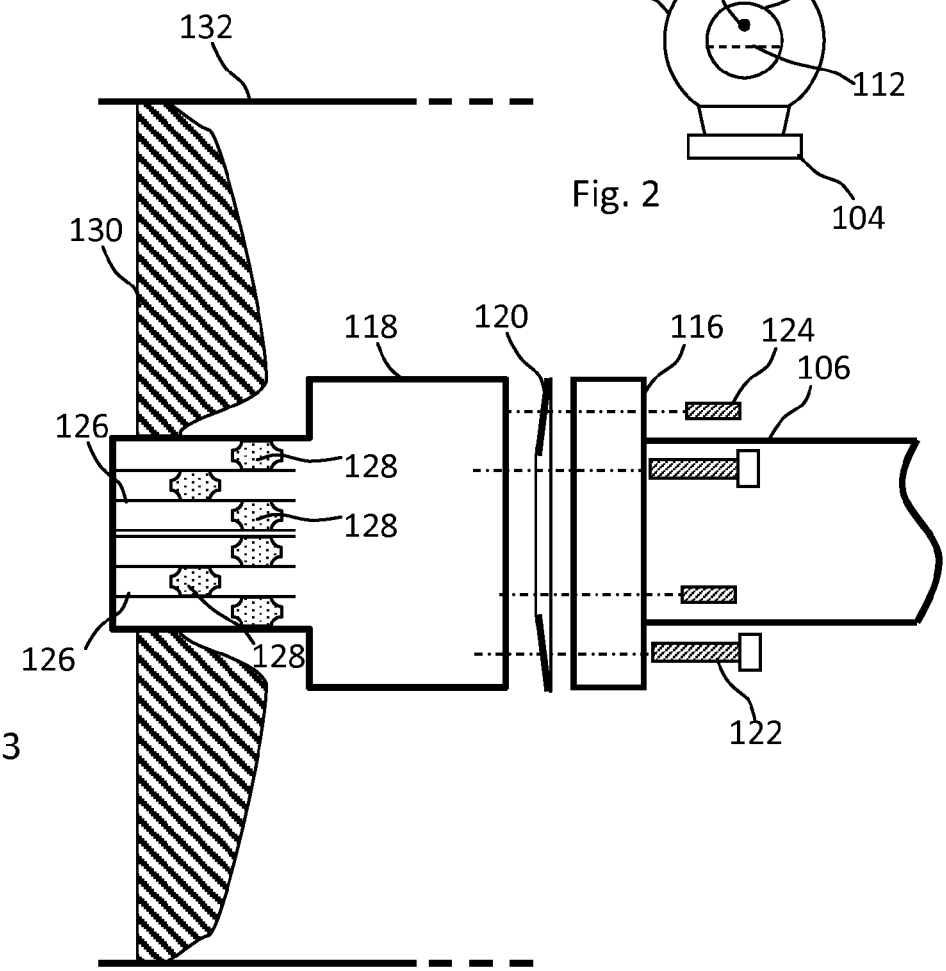
FIG. 3 is a schematic exploded view from the side of a suspension in accordance with one embodiment of the present invention.

FIG. 3 is an exploded side view of a suspension in accordance with an embodiment of the present invention. Reference numerals already introduced in reference to FIGS. 1 and 2 will be reused for like components. A plate spring 120 is sandwiched between the flange 116 of the attachment end 114 and the socket 118. The purpose of the plate spring 120 is to bias the cathode housing 106 in the direction of its free end, away from the socket 118. The flange 116 attaches to the socket 118 by means of three attachment bolts 122 (see also FIG. 4) extending through through-holes of the flange 116 and engaging with threaded holes in the socket 118. The attachment bolts 122 are preferably equidistantly distributed around the circumference of the flange 116. In the illustrated embodiment the attachment bolts 122 extend through bores of the plate spring 120, which bores also serve the purpose of localizing the plate spring 120 correctly. In the flange 116 and between adjacent attachment bolts 122, set screws 124 are arranged (see also FIG. 4). The set screws 124 are arranged in threaded bores of the flange 116 and extend through corresponding bores of the plate spring 120. Unlike the attachment bolts 122 the set screws do generally not extend into the socket 118.

During assembly the cathode housing 106 is attached to the socket 118 using the attachment bolts 122. The attachment bolts 122 are tightened such that the plate spring 120 is only partially compressed. At this point dial indicators or various other techniques may be used to verify the position of the cathode housing 106. If the position has to be adjusted, one or more of the attachment bolts 122 are adjusted, and since the plate spring 120 will bias the flange 116 towards the head of the bolt 122 each such adjustment will result in an alteration of the position of the cathode housing 106. Once the position (inclination) of the cathode housing 106 adequate the set screws 124 are tightened. As the set screws 124 are tightened they will force the flange 116 towards the head of the attachment bolts 122. Thereby they will fixate the flange 116 in the adequate position.

The socket 118 will have to carry the mechanical load comprising the weight of the cathode housing 106, and also provide a seal able to sustain the vacuum inside the tube 102 under varying temperatures. Concentrically arranged cylindrical connectors 126 are arranged in the socket 118. The cylindrical connectors 126 are electrically separated using annular isolators 128, preferably ceramic isolators being brazed to adjacent connectors 126. The annular isolators 128 are arranged in a staggered configuration, where every other isolator 128 is shifted in the longitudinal direction. This configuration enables the socket 118 to absorb the load generated by the weight of the cathode housing 106 as well as effects emanating from temperature variations, such as expansion of the material. The major part of the load is however absorbed by an outermost ring of the connector, and the main purpose of the staggered configuration is to avoid excessive stress during brazing of the isolators 128, during which process the temperature may reach about 900° C., which generally is far higher than the temperature prevailing during operation of the device. The material used for the connectors may be FeNiCo, having a thermal expansion coefficient between that of the ceramic and the stainless steel.

The remote end of the socket 118 (in relation to the cathode housing 106) is brazed to a larger ceramic disc 130 along an inner perimeter thereof. The outer perimeter of the ceramic disc 130 is effectively brazed to an inner diameter of a cylinder segment 132, which in turn is welded to, and forms a part of the tube body 102, which has been discussed earlier. The main purpose of the ceramic disc 130 is to provide electrical insulation between the connection unit 126 and the tube body 102, while also transfer and bear the load from the cathode housing 106. The cylinder segment 132 may be formed from a material having a coefficient of thermal expansion between that of the tube body and of the ceramic material, suggestively FeNiCo. This will reduce the stress induced by temperature variations within the electron-beam device. The ceramic disc 130 may be formed from $Al_2O_3$ as the major constituent.

Figure 4:
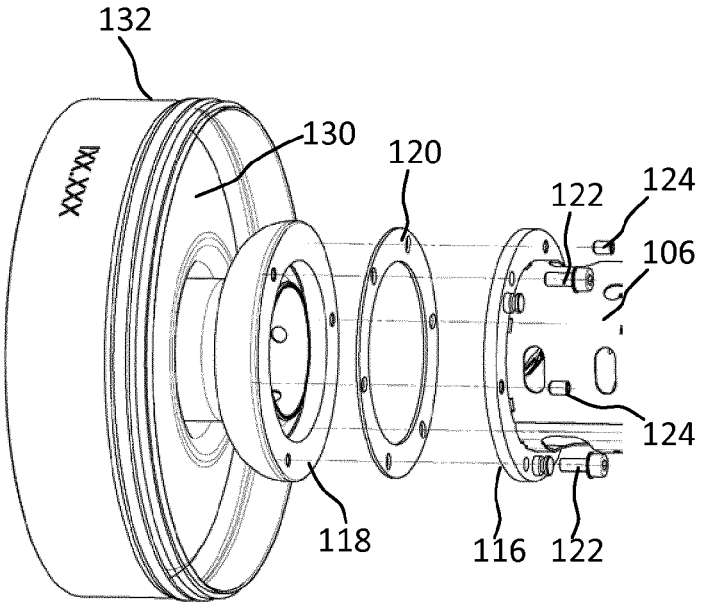
FIG. 4 is an exploded view similar to FIG. 3, yet in perspective and in some more detail.
Figure 5:
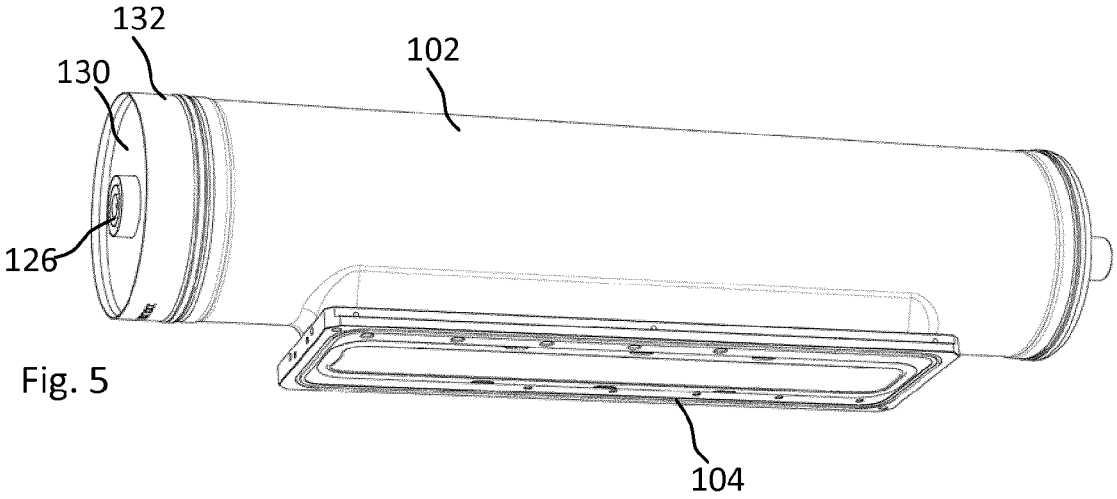
FIG. 5 is a perspective view of an electron beam device similar to FIG. 1 yet in some more detail.

FIG. 4 corresponds to FIG. 3, yet it illustrates a few more details of the suspension and surrounding components in a less schematic way. The mushroom shape of the socket 118 with a curved surface on the side remote to the cathode housing 106, which is visible in the drawing is preferential since it reduces excessive electric field concentrations and the generation of sparks, which would hamper the operation of the EBD. The curved surface may have rotational symmetry around a central longitudinal axis of the EBD, as is visible in the same drawing.

Any electron beam device described in the present application may be a sealed electron beam device, where the vacuum inside the electron beam device inside the EBD is maintained without the continuous use of vacuum pumps. In one assembly step vacuum is generated inside the EBD, after which the opening through which vacuum is drawn, is sealed off permanently.

The invention claimed is:

1. A cathode-housing suspension of an electron beam device having a tubular body of elongate shape with an exit window extending in the longitudinal direction and a connection end in one end of the tubular body, the electron beam device further comprising a cathode housing having an elongate shape and comprising a free end and an attachment end remote to the free end, the attachment end comprising an outwardly extending flange provided with threaded openings for set screws and non-threaded openings for attachment bolts, for attaching the attachment end to a corresponding socket of the tube body, wherein means configured to bias the attachment end away from the socket are arranged in the attachment end.

2. The cathode housing suspension of claim 1, wherein the connector end comprises concentrically arranged cylindrical connector elements separated by annular ceramic spacers, wherein the ceramic spacers are arranged in a staggered fashion, such that adjacent spacers are shifted in the longitudinal direction in relation to each other.

3. The cathode housing suspension of claim 2, wherein every other ceramic spacer is aligned in the longitudinal direction.

4. The cathode housing suspension of claim 1, wherein the biasing means comprises a plate spring arranged between the attachment end and the socket.

5. The cathode housing suspension of claim 4, wherein the plate spring has openings through which the screws and bolts extend.

6. The cathode housing suspension of claim 1, wherein there are three attachment bolts.

7. The cathode housing suspension of claim 1, wherein the connector end comprises a cylinder segment welded to the tubular body and wherein the socket is concentrically suspended in a ceramic isolator disc brazed to the inner perimeter of the cylinder segment.

8. The cathode housing suspension of claim 1, wherein the socket has a curved surface on a side remote to the cathode housing.

9. Method for suspending a cathode housing in a connection end of an electron beam device comprising:

arranging biasing means between an outwardly extending flange of an attachment end of the cathode housing and a corresponding socket of the connection end of the electron beam device, the electron beam device comprising a tubular body of elongate shape with an exit window extending in a longitudinal direction of the tubular body and the connection end being at one end of the tubular body, the cathode housing possessing an elongate shape and comprising a free end which is remote from the attachment end of the cathode housing, compressing the biasing means partially by attachment bolts extending from the outwardly extending flange of the cathode housing and being engaged in threaded openings of the socket, or vice versa, adjusting the attachment bolts until the cathode housing has the desired inclination, fixating the position of the cathode housing by tightening set screws.

10. The method for suspending the cathode housing according to claim 9, wherein the compressing of the biasing means biases the cathode housing away from the socket.

11. The method for suspending the cathode housing according to claim 9, wherein the set screws do not extend into the socket.

12. The method for suspending the cathode housing according to claim 9, wherein the attachment bolts each include a head, and wherein the fixing of the position of the cathode housing by tightening the set screws forces the outwardly extending flange towards the heads of the attachment bolts.

13. A method for suspending a cathode housing in a connection end of an electron beam device comprising:

arranging biasing means between an attachment end of the cathode housing and a corresponding socket of the connection end of the electron beam device, compressing the biasing means by attachment bolts extending from the cathode housing and through the biasing means, and being engaged in threaded openings of the socket, or vice versa, adjusting the attachment bolts extending through the biasing means to position the cathode housing at a desired inclination, and fixing the housing at the desired inclination by tightening set screws which are spaced radially outwardly from a center of the cathode housing.

14. The method for suspending the cathode housing according to claim 13, wherein the compressing of the biasing means biases the cathode housing away from the socket.

15. The method for suspending the cathode housing according to claim 13, wherein the set screws do not extend into the socket.

16. The method for suspending the cathode housing according to claim 13, wherein the cathode housing has an elongate shape and comprises a free end and an attachment end remote from the free end, the attachment end comprising an outwardly extending flange.

17. The method for suspending the cathode housing according to claim 16, wherein the attachment bolts each include a head, and wherein the fixing of the position of the cathode housing by tightening the set screws forces the outwardly extending flange towards the heads of the attachment bolts.

* * * * *